United States Patent [19]

Nishimori et al.

[11] Patent Number: 4,937,623

[45] Date of Patent: Jun. 26, 1990

[54] IMAGE DUPLICATING APPARATUS HAVING CHANGEABLE DOCUMENT SCANNING MODES

[75] Inventors: Kadotaro Nishimori; Kimihiko Higashio; Masazumi Ito, all of Osaka, Japan

[73] Assignee: Minolta Camera Kabushiki Kaisha, Osaka, Japan

[21] Appl. No.: 428,948

[22] Filed: Oct. 30, 1989

[30] Foreign Application Priority Data

Oct. 28, 1988 [JP] Japan ..... 63-273969

[51] Int. Cl.[5] ..... G03G 15/28

[52] U.S. Cl. ..... 355/233; 355/309; 355/313; 355/321

[58] Field of Search ..... 355/313, 309, 233, 321

[56] References Cited

U.S. PATENT DOCUMENTS 4,057,341 11/1977 Sohm .
4,169,674 10/1979 Russel .
4,515,458 5/1985 Masuda et al. ..... 355/313
4,537,497 8/1985 Masuda .
4,866,484 9/1989 Murai et al. .

*Primary Examiner*—A. T. Grimley

*Assistant Examiner*—Thu Dang

*Attorney, Agent, or Firm*—Burns, Doane, Swecker & Mathis

[57] ABSTRACT

In a scan-mode changeable image duplicating apparatus including scanner units for optically scanning a document and having a scanner-moved scanning mode in which the scanner units is driven to move for scanning a document fixedly held in place and a document-moved scanning mode in which the scanner units is fixed to scan a document being moved with respect to the scanner units, a control system comprising an initial scan-mode select switch allowing the user of the apparatus to select one of the scanner-moved and document-moved scanning modes as a preferential initial scanning mode, a duplicating mode select key allowing the user to select a predetermined duplicating mode which is compatible with both of the document-moved and scanner-moved scanning modes, and a control circuit for judging whether or not the predetermined duplicating mode is currently selected by the duplicating mode select key and automatically selecting the preferential initial scanning mode when it is judged that the predetermined duplicating mode is currently selected by the duplicating mode select key.

7 Claims, 5 Drawing Sheets

IMAGE DUPLICATING APPARATUS HAVING CHANGEABLE DOCUMENT SCANNING MODES

FIELD OF THE INVENTION

The present invention relates to an image duplicating apparatus having changeable document scanning modes and, more particularly, to an image duplicating apparatus of the type which allows the user to select either a document-moved scanning mode or a scanner-moved scanning mode.

BACKGROUND OF THE INVENTION

An image duplicating apparatus is known in which the document to be duplicated is scanned by the movable units of the optical system driven for movement with respect to the document which is fixedly held in place. This mode of scanning a document in an image duplicating apparatus is herein referred to as scanner-moved scanning mode. Also known is an image duplicating apparatus in which the document to be duplicated is scanned by the optical system while the document is being moved with respect to the optical system which fixedly held in place. This mode of scanning a document in an image duplicating apparatus is herein referred to as document-moved scanning mode. The present invention is concerned with an image duplicating apparatus which has both the scanner-moved scanning mode and the document-moved scanning mode and which allows the user to select either of the two different scanning modes.

An image duplicating apparatus of the type having such document-moved and scanner-moved scanning modes may be equipped with any optional units or modules. Typical of such optional units are a document feeder unit and a page sorter unit.

The document feeder unit is installed on the document support table of the main module of an image duplicating apparatus and is used to automatically feed a plurality of documents one after another to the document support table of the main module during successive cycles of copying operation. The documents are placed on a document tray of the document feeder unit and are successively fed to the document support table of the main module. When the scanner-moved scanning mode is selected, the document thus fed to the document support table of the main module is fixedly held in place on the document support table and is scanned by the movable units of the optical system which are driven for movement along the document support table. When the document-moved scanning mode is selected, the document fed to the document support table of the main module is driven for movement at a fixed speed on the surface of the document support table and is scanned by the optical system which is fixed with respect to the document support table.

On the other hand, the page sorter unit is installed on the print-sheet discharge side of the main module of the duplicating apparatus. In an image duplicating apparatus equipped with the page sorter unit, printed outputs each having toner images duplicated from the original images on the document or documents scanned and thermally fixed under pressure are successively discharged from the main module and passed to the page sorter unit. The documents thus transferred one after another to the page sorter unit are all collected on a common tray or are selectively distributed to a plurality of bins depending on the mode of operation selected for the sorter unit.

The page sorter unit is operative to handle print sheets in any one of the different modes of operation which typically consist of an ordinary or non-sorting mode, a sorting mode, and a grouping mode.

When the ordinary or non-sorting mode is selected for the page sorter unit, the print sheets successively withdrawn from the main module of the apparatus are all passed to the main sheet discharge tray provided in the sorter unit. The print sheets thus passed to the main sheet discharge tray are stacked on one another in a sequence in which the print sheets have been discharged from the main module of the apparatus.

On the other hand, when the sorting mode is selected for the page sorter unit, the print sheets successively withdrawn from the main module of the apparatus are passed sequentially to the auxiliary sheet discharge bins also provided in the page sorter unit. When, for example, five documents are to be duplicated and three printed outputs are to be produced for each of the documents, three sets of print sheets consisting of five different pages for each set are distributed to three the auxiliary sheet discharge bins, respectively.

When the grouping mode of operation is selected for the page sorter unit, the printed outputs produced from the same document are passed all to the same auxiliary sheet discharge bin. Thus, the printed outputs produced from more than two documents are distributed to the discharge bins sequentially selected depending on the order of the documents scanned and duplicated. When, for example, five documents are to be duplicated and three printed outputs are to be produced for each of the documents, five sets of print sheets consisting of three identical pages for each set are distributed to five auxiliary sheet discharge bins, respectively. It may be noted that, when the grouping mode is selected, the scanner-moved scanning mode is exclusively selected as will be described in more detail.

In a scan-mode changeable image duplicating apparatus, whether the document-moved scanning mode is to be selected or the scanner-moved scanning mode is to be selected is determined upon the following considerations:

CONSIDERATION AS TO DAMAGE TO DOCUMENT

When two or more printed outputs are to be produced from the same document, the document is fed to and withdrawn from the document support table of the main module a number of times which corresponds to the designated number of printed outputs. When a document is thus fed to and withdrawn from the document support table repeatedly, there is a danger of the document being crumpled, folded or otherwise damaged. From the view point of minimizing such a danger, the scanner-moved scanning mode in which a document is to be fixed on the document support table is considered to be preferred over the document-moved scanning mode.

CONSIDERATION AS TO THE LENGTH OF TIME REQUIRED

In the scanner-moved scanning mode, the movable units of the optical system which have been moved along the document support table and have completely scanned the document is required to return to their initial home positions. The period of time which is thus required for the movable units of the optical system has a considerable length and is per se useless for the scanning of the document. From the view point of reducing the total period of time required for the scanning of a document, the document-moved scanning mode in which the optical system as a whole is fixed with respect to the document support table is considered to excel the scanner-moved scanning mode. It may also be noted that the document-moved scanning mode is advantageous over the scanner-moved scanning mode particularly when the grouping mode is selected for the page sorter unit because of the fact that a shorter period of time is required for the completion of the copying operation in the document-moved scanning mode.

CONSIDERATION AS TO THE BINDING OF PRINTED OUTPUTS

In document-moved scanning mode of copying operation, a first complete set of printed outputs duplicating all the documents to be duplicated is collected on an auxiliary sheet discharge bin of the page sorter unit when the documents are scanned and duplicated each only once. As the documents are scanned and duplicated repeatedly, complete sets of printed outputs are thus distributed sequentially to successive sheet discharge bins of the sorter unit. When the document-moved scanning mode is selected, the operator desiring to bind each complete set of printed outputs is allowed to staple or otherwise bind a complete set of printed outputs before another complete set of printed outputs is collected on another sheet discharge bin.

In the scanner-moved scanning mode of copying operation, however, a first complete set of printed outputs could not be collected on an auxiliary sheet discharge bin until all the documents are scanned and duplicated each by a number of times corresponding to the desired number of printed outputs. Accordingly, the operator desiring to bind each complete set of printed outputs is compelled to wait until all the documents are scanned and duplicated each by a preset number of times.

Thus, when it is desired that each of the complete sets of printed outputs be bound, the document-moved scanning mode is preferred over the scanner-moved scanning mode to save time for the binding of the complete sets of printed outputs.

CONSIDERATION AS TO AVAILABILITY OF SORTER

It may happen that the operator of the apparatus selects the sorting mode for the page sorter unit although the sorter unit is in actuality not assembled to the apparatus. On such an occasion, printed outputs could not be assorted in the scanner-moved scanning mode and for this reason the document-moved scanning mode must be selected exclusively. As has been noted, a plurality of documents successively exposed to light in a document feeder unit of the recirculating document type are returned to the document tray and are placed one upon another in the same sequence as the documents were initially placed on the tray. In a duplicating apparatus equipped with a document feeder unit of the recirculating document handler type, printed outputs can thus be assorted in the document-moved scanning mode if there is no sorter unit available in the duplicating apparatus.

In the meantime, there may be a case where the operator of the apparatus could not assuredly determine which of the document-moved scanning mode and the scanner-moved scanning mode is advantageous for the mode of copying operation selected by the operator. The present invention contemplates provision of a scan-mode changeable image duplicating apparatus in which either the document-moved scanning mode or the scanner-moved scanning mode is automatically selected depending on the mode of operation selected for the page sorter unit and on the mode of scanning selected as "preferential initial scanning mode". The preferential initial scanning mode is selected by the user of the apparatus in consideration of the most frequently used ranges of the number of documents to be duplicated, the number of printed outputs to be produced and any other parameters that deserve consideration by the user and the user's desired order of priority in which the above described "considerations" are to be taken into account. It may be noted that these factors are more or less peculiar to the environments in which the apparatus is to be used and may vary from one user to another.

SUMMARY OF THE INVENTION

It is, accordingly, an important object of the present invention to provide an improved image duplicating apparatus which allows the user to select one of the document-moved scanning mode and document-moved scanning mode as the preferential initial mode of scanning and which is capable of automatically selecting the other of the scanning modes depending on the mode of copying operation selected by the user. The mode of copying operation herein referred to is, particularly, the mode of operation selected for the page sorter unit which forms part of the apparatus and may thus be any of the sorting mode and the grouping mode which may be selected by the user of the apparatus.

In accordance with an outstanding of the present invention, there is provided in a scan-mode changeable image duplicating apparatus including scanning means for optically scanning a document and having a scanner-moved scanning mode in which the scanning means is driven to move for scanning a document fixedly held in place and a document-moved scanning mode in which the scanning means is fixed to scan a document being moved with respect to the scanning means, a control system comprising (a) initial scan-mode selecting means allowing the user of the apparatus to select one of the scanner-moved and document-moved scanning modes as a preferential initial scanning mode, (b) duplicating mode selecting means allowing the user to select a duplicating mode which is compatible with both of the document-moved and scanner-moved scanning modes, (c) judging means for judging whether or not the duplicating mode is currently selected by the duplicating mode selecting means, and (d) automatic scan-mode selecting means for automatically selecting the preferential initial scanning mode when it is judged by the judging means that the duplicating mode is currently selected by the duplicating mode selecting means.

BRIEF DESCRIPTION OF THE ACCOMPANYING DRAWINGS

The features and advantages of an image duplicating apparatus according to the present invention will be more clearly understood from the following description taken in conjunction with the accompanying drawings in which.

PREFERRED EMBODIMENT OF THE INVENTION

Figure 1:
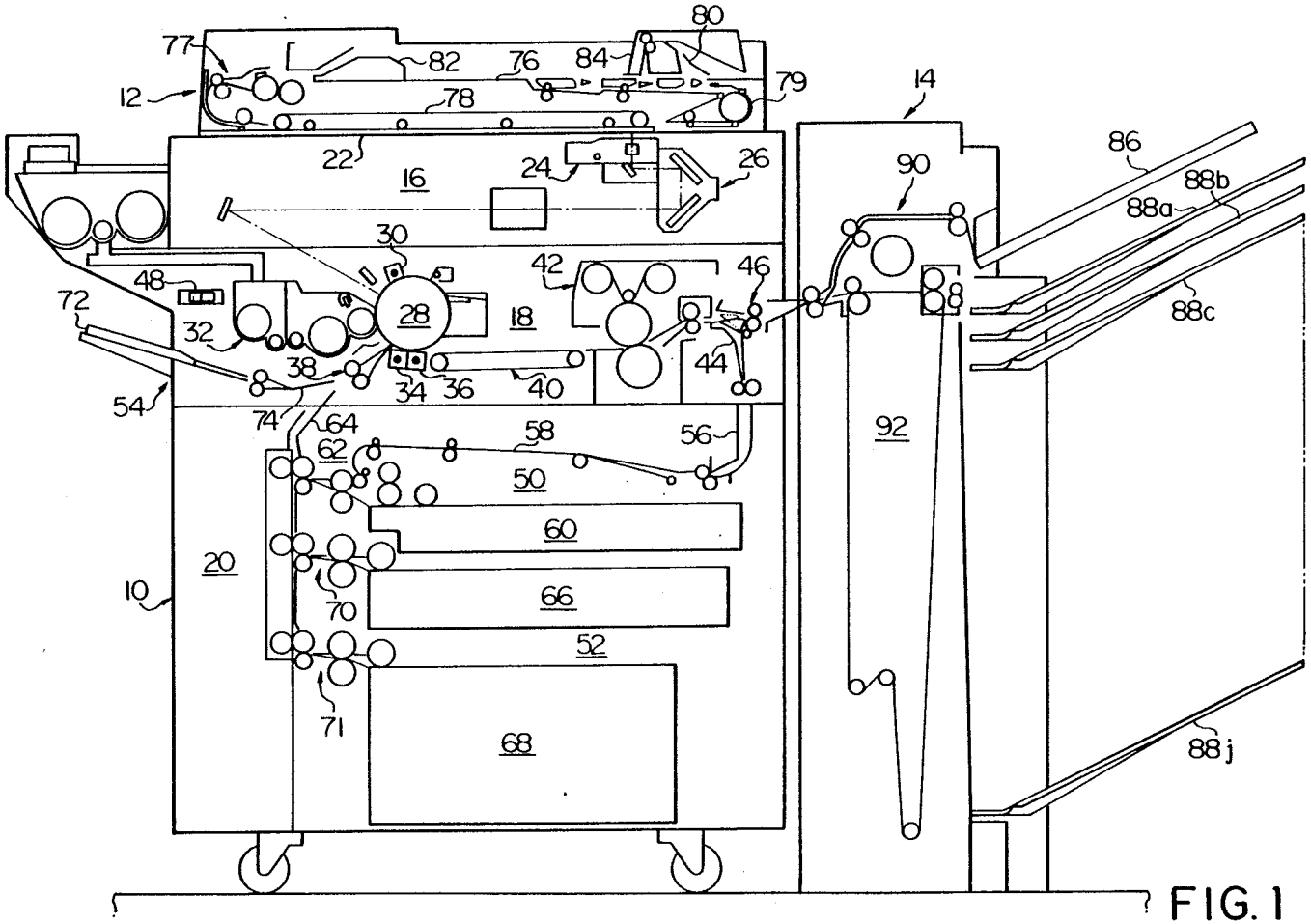
FIG. 1 is a schematic front elevation view showing the general mechanical construction and arrangement of a preferred embodiment of a scan-mode changeable image duplicating apparatus according to the present invention.

Description will be hereinafter made with reference to FIG. 1 regarding the general mechanical construction and arrangement of a preferred embodiment of a scan-mode changeable image duplicating apparatus according to the present invention.

As shown, the scan-mode changeable image duplicating apparatus embodying the present invention generally comprises a main module 10, a document feeder unit 12 mounted on the main module 10, and a page sorter unit 14 positioned on the print-sheet discharge side of the main module 10.

[1]Main Module 10

The main module 10 comprises an upper optical system 16, an intermediate image reproducing stage 18, and a lower print-sheet supply stage 20.

Optical System 16

The optical system 16 of the main module 10 is disposed below a transparent document support table 22 on which a document (not shown) is to be placed, and largely comprises a first movable scanning unit 24 and a second movable scanning unit 26. Each of these first and second movable scanning units 24 and 26 is movable back and forth along the document support table 22. The first movable scanning unit 24 comprises an exposure lamp and a first reflector mirror mounted on a common carrier. The second movable scanning unit 26 comprises second and third reflector mirrors mounted on a common carrier.

The optical system 16 as a whole is adapted to illuminate the document on the document support table 22 with a beam of light emitted from the exposure lamp and directs the reflected light toward the image reproducing assembly 18 as will be described in more detail.

In the scan-mode changeable image duplicating apparatus embodying the present invention, two different modes of scanning are available which consist of the document-moved scanning mode and the scanner-moved scanning mode. When the document-moved scanning mode is in effect, the document on the document support table 22 is driven to move on the table 22 with the first and second movable scanning units 24 and 26 of the optical system 16 fixedly held in place. In this document-moved scanning mode, the document on the document support table 22 is driven to move at a fixed speed on the table 22 by means of the document feed unit 12, as will be also described in more detail.

On the other hand, when the scanner-moved scanning mode is selected, each of the first and second movable scanning units 24 and 26 of the optical system 16 is driven to move with along the document support table 22 with the document fixedly held in place on the table 22. In this scanner-moved scanning mode, the first and second movable scanning units 24 and 26 of the optical system 16 are driven to move at fixed speeds V/N and V/2N, respectively, where V is the peripheral speed of rotation of a photosensitive drum included in the image reproducing stage 18 and N is the selected reduction/-magnification ratio for image reproduction. The document on the document support table 22 is scanned by these first and second movable scanning unit 24 and 26 when the movable scanning units 24 and 26 are driven to move leftwardly in FIG. 1 along the document support table 22.

Image Reproducing Stage 18

The image reproducing stage 18 is adapted to reproduce images on a print sheet by an electrophotographic process. The image reproducing stage 18 comprises a photosensitive drum 28 and various devices disposed around the drum 28. These devices include a charger 30, a developing assembly 32, a transfer charger 34, and a separation charger 36 as shown.

The image reproducing stage 18 further comprises a print-sheet feed mechanism comprising a pair of timing rollers 38 and a print-sheet transport belt assembly 40. The timing roller pair 38 is adapted to feed a print sheet (not shown) in between the photosensitive drum 28 and the transfer charger 34 at a controlled timing. The print-sheet transport belt assembly 40 is operative to transport a print sheet away from the photosensitive drum 28 toward an image fixing assembly 42 after toner images are transferred to the surface of the print sheet.

The image fixing assembly 42, which also forms part of the image reproducing stage 18, is adapted to heat and press the toner images on the print sheet received from the belt assembly 40 and fix the toner images on the surface of the sheet. The print sheet having the toner images thus fixed thereon is either withdrawn from the main module 10 or recirculated toward the image reproducing stage 18. A shifting device 44 is thus provided to direct the print sheet toward a pair of sheet discharge rollers 46 or toward the print-sheet supply stage 20.

In association with the image reproducing stage 18 thus constructed and arranged is located a preferential scan-mode select switch 48 which allows the user of the apparatus to select either the document-moved scanning mode or the scanner-moved scanning mode as the preferential initial scanning mode. Typically, the preferential scan-mode select switch 48 is conditioned to select the scanner-moved scanning mode as the default scanning mode of the apparatus under consideration. The preferential scan-mode select switch 48 may be implemented by a dip switch (dual in-line package switch).

PRINT-SHEET SUPPLY STAGE

The print-sheet supply stage 20 of the image duplicating apparatus embodying the present invention largely comprises a sheet re-circulation assembly 50, a print-sheet storage/supply assembly 52, and a manual sheet feeder unit 54.

The sheet re-circulation assembly 50 comprises guide members 56 and 58, a re-circulation sheet storage tray 60, and an associated set of rollers 62. A print sheet having toner images fixed thereon by means of the image fixing assembly 42 is driven to travel along the guide members 56 and 58 away from the shifting device 46 and is temporarily stored in the re-circulation sheet storage tray 60. The rollers 62 are arranged so that the print sheet thus stored in the tray 60 is drawn out of the tray and is conveyed toward the timing roller pair 38 of the image reproducing stage 18 by way of a guide member 68.

The print-sheet storage/supply assembly 52 comprises print-sheet storage cassettes 66 and 68 and respectively associated sets of rollers 70 and 71. Each of the print-sheet storage cassettes 66 and 68 has stored therein a stock of fresh print sheets of a standard size. Print sheets are thus supplied one after another from a selected one of the cassettes 66 and 68 and conveyed through the guide member 64 toward the timing roller pair 38 of the image reproducing stage 18 by means of the set of rollers 70 or by the set of rollers 71.

The manual sheet feeder unit 54 is provided to allow the operator of the apparatus to manually feed a print sheet into the main module 10. Such a manual sheet feeder unit 54 comprises a manual sheet inlet member 72 and a guide member 74 for guiding a print sheet from the inlet member 72 toward the timing roller pair 38 of the image reproducing stage 18.

[2]Document Feeder Unit 12

The document feeder unit 12 comprises a document tray 76 to have a document placed thereon and is adapted to feed the document onto the upper face of the document support table 22 through a set of document feed rollers 77 which are shown located in the neighborhood of the leftmost end of the document feeder unit 12 and a belt assembly 78.

When the document-moved scanning mode is established, the document is drawn from the document tray 76 and is driven to move on the document support table 22 rightwardly in FIG. 1 by means of the document feed rollers 78 and belt assembly 78. While the document is being thus moved at a fixed speed on the upper face of the document support table 22, the images on the lower face of the document is scanned by the first and second movable scanning unit 24 and 26 of the optical system 16 fixedly held in place below the document support table 22. On completion of the scanning operation, the document is returned to the document tray 76 by way of guide members 79 and 80 which are shown located in the vicinity of the rightmost end of the document feeder unit 12.

When the scanner-moved scanning mode is in effect, the document drawn from the document tray 76 and driven to move on the document support table 22 rightwardly in FIG. 1 by the document feed rollers 77 and belt assembly 78 until the document reaches a predetermined position on the document support table 22. The document is then fixedly held in this position on the document support table 22 and is scanned by the first and second movable scanning units 24 and 26 which are driven to move leftwardly along the document support table 22. When it is desired to produce a plurality of printed outputs from the same document, the first and second movable scanning units 24 and 26 may be driven for reciprocating movement repeatedly by a number of times which corresponds to the selected number of printed outputs. On completion of the scanning operation, the document is also returned to the document tray 76 by way of the guide members 79 and 80.

To feed a document to the document support table in the document-moved or scanner-moved scanning mode by means of the document feeder unit 12, a document is placed on the document tray 76 with its front image-bearing face directed upwardly. A pair of movable guide members 82 is provided on the document tray 76 to prevent lateral deviation or skewing of the document thus placed on the document tray 76. The document on the document tray 76 is then drawn from the tray 76 and is driven to travel rightwardly on the document support table 22 by means of the document feed rollers 77 and belt assembly 78. It may be noted that, when two or more documents are placed on the document tray 76, the documents are to be drawn from the document tray 76 one after another from the lowermost one of the documents.

When the scanning of the document is complete, the document is returned to the document tray 76 through the guide members 79 and 80. If necessary, the document which has thus been returned to the document tray 76 may be drawn from the document tray 76 to the document support table 22 for being scanned and duplicated for a second time.

When a plurality of documents are to be duplicated, the document first drawn from the document tray is monitored for its size. To discharge thed the stack of the documents to a predetermined position on the document tray 76 in the direction of travel from the document tray 76, a document discharge unit 84 is provided which is adapted to move in the neighborhood of such a position on the document tray 76 in accordance with the monitored size.

Thus, the document feeder unit 12 forming part of the duplicating apparatus embodying the present invention is of the recirculating document handler (RDH) type which per se is well known in the art. In a document feeder unit of the recirculating document type, a plurality of documents successively exposed to light on the document support table 12 are returned to the tray 76 and are placed one upon another in the same sequence as the documents were initially placed on the tray 76.

[3]Page Sorter Assembly 14

The page sorter unit 14 comprises a main sheet discharge tray 86 and a plurality of auxiliary sheet discharge bins **88*a*, 88*b*, . . . 88*j* and is adapted to discharge print sheets all to the main sheet discharge tray 88 or to some or all of the auxiliary sheet discharge bins 88*a*, 88*b*, . . . 88*j*. The page sorter unit 14 is operative to handle the print sheets in any one of the three different modes of operation which consist of an ordinary or non-sorting mode, a sorting mode, and a grouping mode. Each of these different modes of operation of the page sorter unit 14 can be selected on the control panel (100, to be described with reference to FIG. 2**) of the apparatus arbitrarily by the operator as will be described in more detail.

Non-sorting Mode

When the ordinary or non-sorting mode is selected for the page sorter unit 14, the print sheets successively withdrawn from the main module 10 are passed through a guide and roller arrangement assembly 90 all to the main sheet discharge tray 86. The print sheets are withdrawn to the main sheet discharge tray 86 and are stacked on one another in a sequence in which the print sheets have been discharged from the sheet discharge roller pair 46.

Sorting Mode

On the other hand, when the sorting mode is selected for the page sorter unit 14, the print sheets successively withdrawn from the main module 10 of the apparatus are passed through a belt and roller arrangement 92 sequentially to some or all of the auxiliary sheet discharge bins 88*a*, 88*b*, 88*c*, . . . 88*j*. The sequence in which the print sheets are to be withdrawn to the discharge bins 88*a*, 88*b*, 88*c*, . . . depends on the selected mode of scanning operation.

Assume now that the scanner-moved scanning mode is selected and that "three" is selected as the number of printed outputs to be produced from each of the documents stacked on the document tray 76. When the operator's instruction to start the copying operation is entered on the control panel, a first page document will be fed to and placed on the document support table 22 by means of the document feeder unit 12 and will be thereafter scanned by the optical system 16. In this instance, the document on the document support table 22 is scanned and duplicated a total of three times with each of the first and second movable scanning unit 24 and 26 of the optical system 16 driven for three reciprocating motions along the document support table 22. Each time the document is scanned by the optical system 16, a single printed output is produced and is discharged from the main module 10 to the page sorter unit 14. The three print sheets successively discharged from the main module 10 as the document on the document support table 22 is scanned and duplicated three times are thus distributed through the belt and roller arrangement 92 sequentially to the discharge bins 88*a*, 88*b* and 88*c*, respectively.

A second page document will be then fed to and placed on the document support table 22 by means of the document feeder unit 12 and will be thereafter scanned by the optical system 16. The second page document is also scanned and duplicated three times by the optical system 16 so that three print sheets each having images duplicated from the second document are successively discharged from the main module 10. These three print sheets are also distributed through the belt and roller arrangement 92 sequentially to the discharge bins 88*a*, 88*b* and 88*c*, respectively. In these manners, print sheets are discharged to each of the three auxiliary sheet discharge bins 88*a*, 88*b* and 88*c* and are stacked on one another in a sequence in which the documents from which the print sheets have respectively resulted were initially stacked on the document tray 76.

Assume, on the other hand, that the document-moved scanning mode is selected and that "three" is also selected as the number of printed outputs to be produced from each of the documents stacked on the document tray 76 When the operator's instruction to start the copying operation is entered on the control panel, a first page document will be fed to the document support table 22 by means of the document feeder unit 12 and scanned by the optical system 16 while the document is being moved on the document support table 22 On termination of the scanning operation, the first document is returned by way of the guide members 79 and 80 to the document tray 76. The printed output produced by the first scanning of the first page document is discharged from the main module 10 to the first discharge bin 88*a* of the page sorter unit 14.

A second page document will be then fed to the document support table 22 by the document feeder unit 12 and scanned by the optical system 16 while the document is being moved on the document support table 22 When the scanning of the second page document is complete, the document is also returned by way of the guide members 79 and 80 to the document tray 76. The printed output produced by the first scanning of the second page document is discharged from the main module 10 to the first discharge bin 88*a* of the page sorter unit 14 and is stacked on the print sheet resulting from the first scanning of the first page document.

Printed outputs produced by the first scanning of all the documents initially stacked on the document tray 76 are in these manners stacked on the first discharge bin 88*a* of the page sorter unit 14. Apparently, the print sheets discharged to the discharge bin 88*a* are stacked on one another in a sequence in which the documents from which the print sheets have respectively resulted were initially stacked on the document tray 76.

In like manners, the printed outputs produced by the second scanning of the individual documents are discharged successively to the second discharge bin 88*b* and are stacked on one another in a sequence in which the documents from which the print sheets have respectively resulted were stacked on the document tray 76. Subsequently, the printed outputs produced by the third scanning of the documents are discharged to the third discharge bin 88*c* and are stacked on one another in a sequence in which the documents from which the print sheets have respectively resulted were stacked on the document tray 76. The duplicating operation for the documents comes to an end when three sets of printed outputs are thus delivered to the discharge bins 88*a*, 88*b* and 88*c*, respectively, of the page sorter unit 14.

Grouping Mode

With selection of the grouping mode of operation for the page sorter unit 14, the scanner-moved scanning mode is exclusively selected as will be described in more detail.

When the grouping mode is selected, the printed outputs produced from the same document are passed through the belt and roller arrangement 92 all to the same auxiliary sheet discharge bin. Thus, the printed outputs produced from the first page document are successively passed to the first discharge bin 88*a*, the printed outputs produced from the second page document are successively passed to the second discharge bin 88*b*, and so on. Accordingly, the discharge bins 88*a*, 88*b*, . . . of the page sorter unit 14 have respectively received thereon those sets of print sheets which occur in a sequence in which the documents from which the individual sets of print sheets have respectively resulted were initially stacked on the document tray 76.

Figure 2:
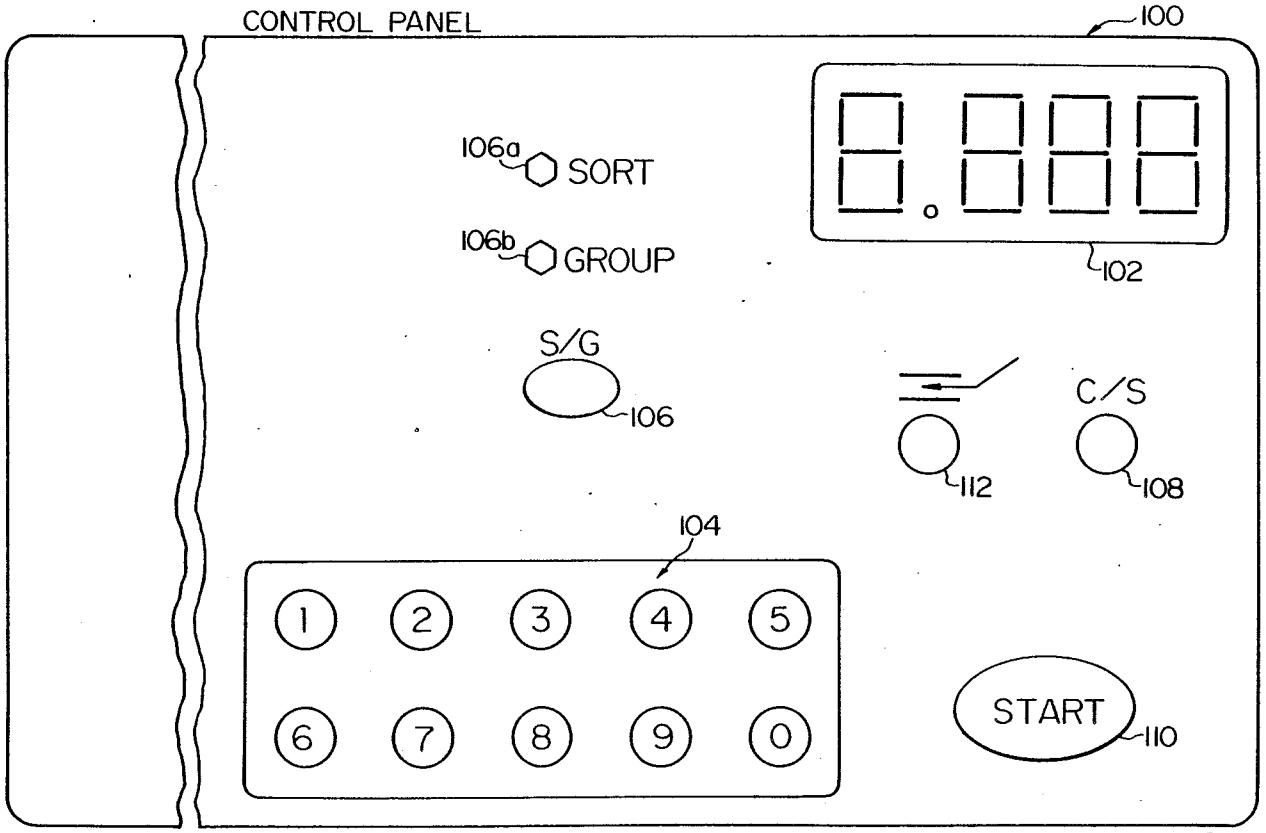
FIG. 2 is a fragmentary plan view showing a portion of a control panel which forms part of the image duplicating apparatus illustrated in FIG. 1.

FIG. 2 shows a portion of a control panel 100 which forms part of the image duplicating apparatus hereinbefore described with reference to FIG. 1.

The control panel 100 has various control keys and indicators provided thereon though not all of such keys and indicators are herein shown. The keys and indicators provided on the control panel 100 herein shown include a display section 102 adapted to display a four-digit numerical value indicating the designated number of printed outputs to be produced for a single document or the designated reduction/magnification ratio for duplication. The number of printed outputs to be produced for a single document or the reduction/magnification ratio for duplication is entered by the operator of the apparatus at any of numerical keys 104.

The keys and indicators provided on the control panel 100 further include a sorting/grouping mode select key 106 which is to be used to select either the sorting mode or the grouping mode of operation in the page sorter unit 14. Associated with this sorting/grouping mode select key 106 are an indicator **106*a* which is to be turned on to illuminate when the sorting mode is selected at the key 106 and an indicator 106*b* which is to be turned on to illuminate when the grouping mode is selected at the key 106. It may be noted that, when the sorting/grouping mode select key 106 is depressed repeatedly, the sorting-mode and grouping-mode indicator 106*a* and 106*b* are turned on alternately after the indicators are turned off concurrently. Thus, when both the indicator 106*a* and 106*b* are turned off concurrently, the ordinary or non-selected mode of operation is selected for the page sorter unit 14. The number of printed outputs to be produced, the reduction/magnification ratio for duplication, the mode of operation of the page sorter unit, and/or any other mode and conditions of operation which have once entered can be cancelled by a clear/stop key 108**.

On the control panel 100 is further provided a print start key 110 through which the operator's instruction to start copying operation is to be entered. The clear/stop key 108 can be used also for interrupting the copying operation before the copying operation initially intended is completed. Further provided on the control panel 100 is an interrupt request key 112 through which the operator of the apparatus is allowed to instruct interruption of the copying operation currently in progress and copying of another document or documents before the copying operation which has been in progress is completed.

Figure 3:
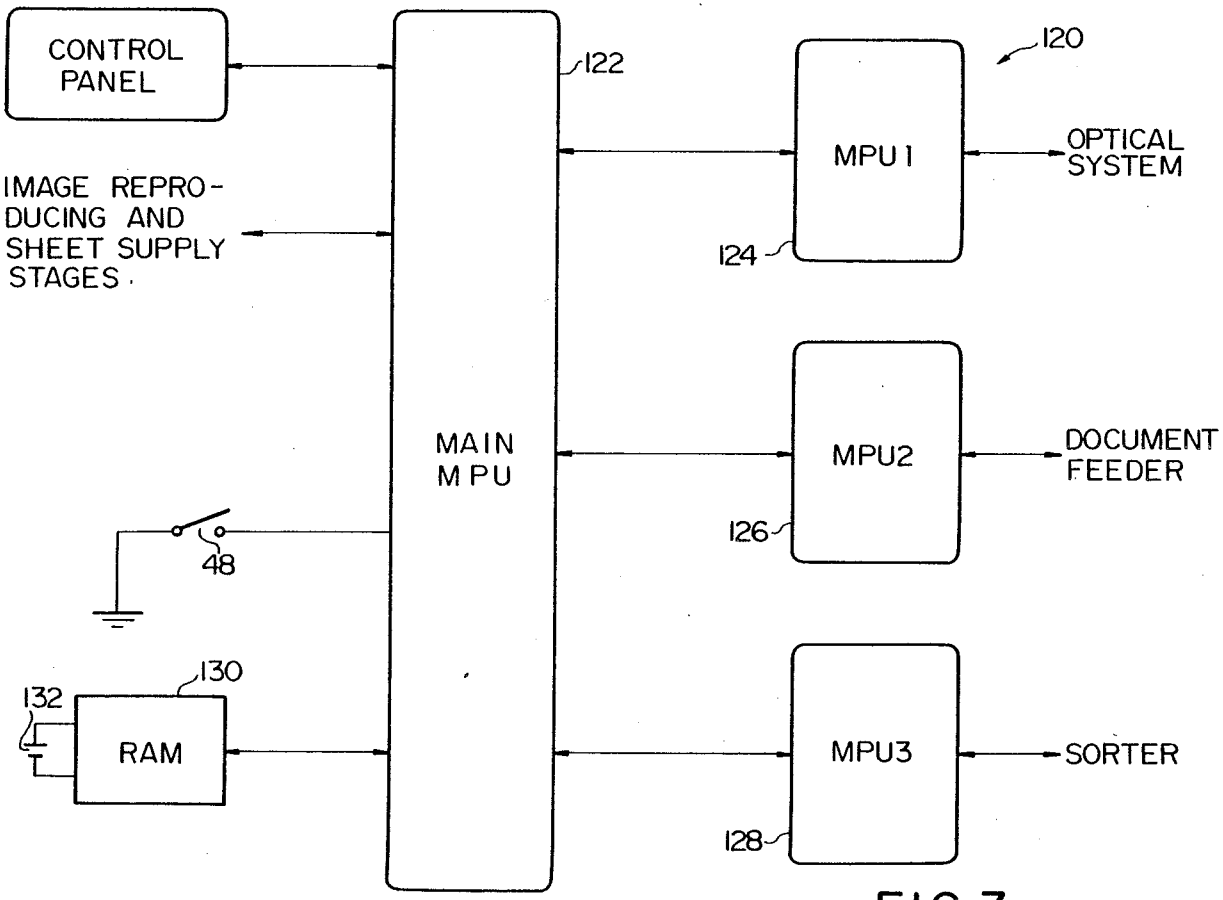
FIG. 3 is a diagram showing the general arrangement of a microprocessor-based control system incorporated in the preferred embodiment of the present invention.

FIG. 3 shows the general arrangement of a microprocessor-based control system 120 incorporated in the embodiment of the present invention. The control system 120 comprises a main microprocessor 122 and first, second and third subsidiary microprocessors 124, 126 and 128.

The main microprocessor 122 (MPU) is predominant over all the operational aspects of the main module 10 of the duplicating apparatus embodying the present invention except for those of the optical system 16. The main microprocessor 122 is thus responsive to various control and instruction signals supplied from the control panel 100 and to signals produced by various sensors and detectors (not shown) provided in the image reproducing and print-sheet supply stages 18 and 20 of the main module 10.

In addition, the main microprocessor 122 is operative to supply signals to the control panel 100 to selectively actuate the various indicators and display elements provided on the control panel 100. The main microprocessor 122 is further operative to supply signals to the various active units and elements included in the image reproducing and print-sheet supply stages 18 and 20 of the main module 10 to selectively actuate the active units and elements.

The first subsidiary microprocessor 124 (MPU1) is used to control the operation of the optical system 16 of the main module 10. The first subsidiary microprocessor 124 is thus responsive to the sensors and detectors (not shown) included in the optical system 16 and actuates the active units such as the first and second movable scanning units 24 and 26 of the optical system 16.

The second subsidiary microprocessor 126 (MPU2) is in control of the operation of, particularly, the document feeder unit 12. The second subsidiary microprocessor 126 is thus responsive to the sensors and detectors (not shown) included in the document feeder unit 12 and actuates the active units and elements included in the document feeder unit 12.

The third subsidiary microprocessor 128 (MPU3) is adapted to control the operation of the page sorter unit 14. The third subsidiary microprocessor 128 is thus responsive to the sensors and detectors (not shown) included in the page sorter unit 14 and actuates the active units and elements included in the sorter unit 14.

The various pieces of information which are thus supplied to the control panel 100 and subsidiary microprocessors 124, 126 and 128 are transferred to the main microprocessor 122 and are loaded into a random-access memory 130 (RAM) directly or after being processed by the microprocessor 122. The random-access memory 130 has a built-in backup power source 132 to assuredly retain the information thus stored in the memory 130.

Among the sensors and detectors supplying signals to the main microprocessor is the preferential scan-mode select switch 48 selecting the scanner-moved scanning mode as the preferential initial scanning mode. As has been described, the scanner-moved scanning mode is selected by a system default rule with the switch 48 opened and, when the switch 48 is closed, the document-moved scanning mode is established automatically.

Whereas, there may be a case where the operator of the apparatus could not assuredly determine which of the document-moved scanning mode and the scanner-moved scanning mode is advantageous for the mode of copying operation selected by the operator. Under such circumstances, the scanning mode is selected depending on the current state of the preferential scan-mode select switch 48. Thus, the document-moved scanning mode will be selected as the initial scanning mode if the switch 48 happens to be closed and, if the switch 48 happens to be open, the scanner-moved scanning mode will be selected as the initial scanning mode.

On the other hand, there will be cases where the operator of the apparatus is assured of one of the two scanning modes being preferred over the other for the selected mode of copying operation. In this instance, the preferred mode of scanning can be selected on manipulation of the preferential scan-mode select switch 48. It will be apparent that, when only a particular one of the two scanning modes is valid for the selected mode of copying operation, the particular scanning mode is selected automatically without respect to the current state of the switch 48. An example of such a mode of copying operation is the grouping mode selected for the page sorter unit 14 as will be described in more detail.

Figure 4:
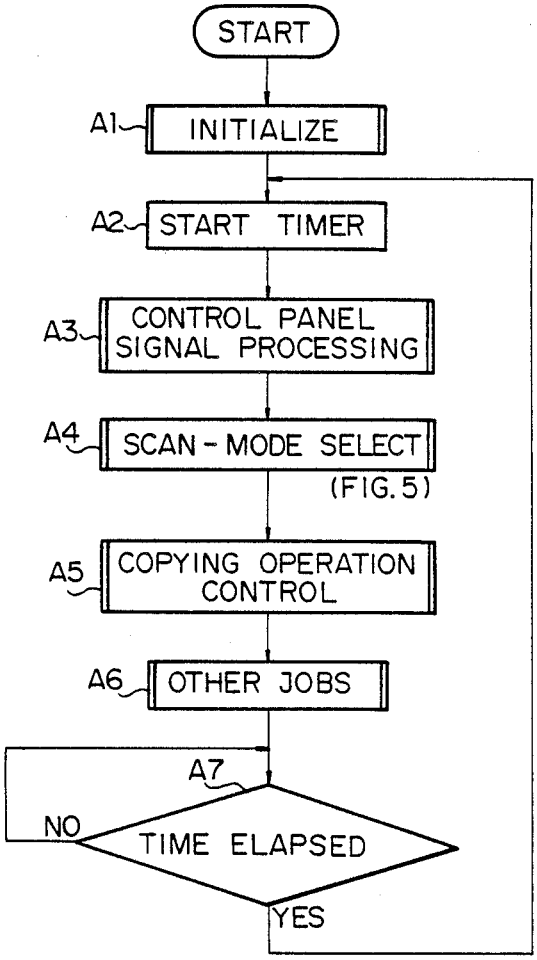
FIG. 4 is a flowchart showing the flow of the main routine program to be executed by a main microprocessor forming part of the control system illustrated in FIG. 3.
Figure 5:
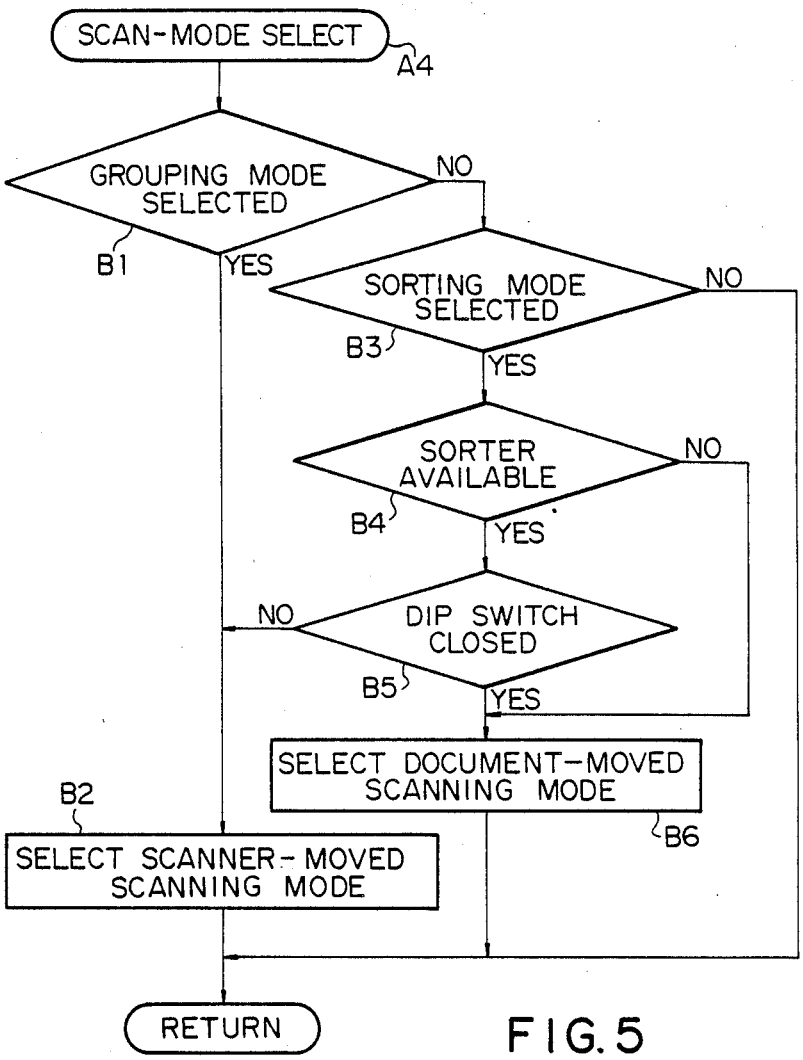
FIG. 5 is a flowchart showing the details of a scan-mode select subroutine program included in the main routine program illustrated in FIG. 4.

FIG. 4 is a flowchart showing the flow of the main routine program to be executed by the main microprocessor 122 forming part of the control system 120 hereinbefore described with reference to FIG. 3. FIG. 5 is a flowchart showing the details of a scan-mode select subroutine program included in the main routine program illustrated in FIG. 4.

Main Routine Program

The main microprocessor 122 is activated to start execution of the main routine program when the main switch (power supply switch, not shown) of the apparatus is closed by the operator. Thus, the main microprocessor 122 first proceeds to step A1 to initialize all the variable parameters in the system to the starting values selected by the system default rules. At this step A1, the microprocessor 122 detects the current state of the preferential scan-mode select switch 48 and selects the document-moved scanning mode as the initial scanning mode if the switch 48 is found closed or the scanner-moved scanning mode as the initial scanning mode if the switch 48 is found open.

On completion of the initialization of the system, the main microprocessor 122 activates the system internal timer which is set for a period of time required for the single itineration through the subsequent steps of the main routine program. Subsequently, the main microprocessor 122 proceeds to subroutine program A3 to process the signals which may have been received from the control panel 100 and sends signals to selectively actuate the various indicators and display elements provided on the control panel 100.

The subroutine program A3 is followed by a scan-mode select subroutine program A4 at which the main microprocessor 122 selects either the document-moved scanning mode or the scanner-moved scanning mode for the copying operation which is about to be carried out. In selecting the mode of scanning, the microprocessor 122 checks if either the sorting mode or the grouping mode is selected for the page sorter unit 14 and, if necessary, detects the current state of the preferential scan-mode select switch 48. The details of this scan-mode select subroutine program A4 will be hereinafter described with reference to FIG. 5.

Subsequently to the scan-mode select subroutine program A4, the main microprocessor 122 proceeds to subroutine program A5 to process the signals received and generates signals to actuate the various active units and elements which contribute to the execution of copying operation. The main microprocessor 122 then proceeds to subroutine program A6 to perform various jobs which are required to complete the copying operation and thereafter checks at step A7 if the period of time set for the system internal timer has elapsed. When it is confirmed at step A7 that the period of time set for the timer has elapsed, the microprocessor 122 reverts to step A2 and reiterates the step A2, subroutine programs A3 to A6 and step A7.

Scan-Mode Select Subroutine Program

In the scan-mode select subroutine program A4, it is detected if there has been an event which requires selection of a particular scanning mode and, if it is confirmed that such an event has taken place, it is further detected what the event is and, if necessary, the current state of the preferential scan-mode select switch 48 is monitored. Either the document-moved scanning mode or the scanner-moved scanning mode is selected on the basis of the results of these heuristic procedures.

Such a scan-mode select subroutine program A4 starts with step B1 at which the main microprocessor 122 checks if the grouping mode is selected for the page sorter unit 14 from the sorting/grouping select key 106 on the control panel 100. When the answer for this step B1 is given in the affirmative, the microprocessor 122 selects the scanner-moved scanning mode at step B2. It will be readily understood that, when the grouping mode is selected so that all the printed outputs for the same document are to be collected on the same bin, the scanner-moved scanning mode in particular is preferred over the document-moved scanning mode since the former requires a significantly shorter period of time for completing the copying operation for a plurality of documents.

If it is determined at step B1 that the grouping mode is not selected, the main microprocessor 122 proceeds to step B3 to check if the sorting mode is selected from the key 106 on the control panel 100. When the answer for this step B3 is given in the affirmative, then the microprocessor 122 confirms at step B4 if there is the page sorter unit 14 assembled to the main module 10.

If it is determined at step B4 that the page sorter unit 14 is available in the apparatus, the microprocessor 122 further detects at step B5 if the preferential scan-mode select switch 48 is closed. If the switch 48 is found to be closed, the microprocessor 122 proceeds to step B6 to select the document-moved scanning mode. The document-moved scanning mode is also selected when it is found at step B4 that the page sorter unit 14 is not available in the apparatus. As has been noted, printed outputs can be assorted in the document-moved scanning mode if there is no sorter unit available in a duplicating apparatus equipped with a document feeder unit of the recirculating document handler type. If it is found at step B5 that the preferential scan-mode select switch 48 is open, the microprocessor 122 proceeds to step B2 to select the scanner-moved scanning mode.

After the scanner-moved or document-moved scanning mode is thus selected at step A2 or A6, respectively, or when it is found at steps B1 and B3 that neither the grouping mode nor the sorting mode is selected for the page sorter unit 14, the main microprocessor 122 returns to the main routine program described with reference to FIG. 4.

While it has been stated that the preferential initial scanning mode is selected with use of the preferential scan-mode select switch 48 implemented by a dip switch, the function of such a switch 48 may be achieved by software incorporated into the memory 130. For this purpose, data representing a preferred one of the document-moved and scanner-moved scanning modes is stored in the memory 130 and is read out to determine which of the two modes of scanning is selected as the preferential scanning mode at a step substituting the step B5 of the subroutine program described with reference to FIG. 5. In this instance, arrangements may be made so that the scanning mode which has once stored in the memory can be substituted by the other scanning mode through manipulation of, for example, a scan-mode select key which may be additionally provided on, for example, the control panel 100.

As will have been understood from the foregoing description, a scan-mode changeable image duplicating apparatus according to the present invention allows the user to select one of the document-moved scanning mode and document-moved scanning mode as the preferential initial mode of scanning and is capable of automatically selecting the other of the scanning modes depending on the mode of copying operation selected by the user. When the user of the apparatus could not assuredly determine which of the document-moved scanning mode and the scanner-moved scanning mode is advantageous for the mode of copying operation selected by the operator, either the document-moved scanning mode or the scanner-moved scanning mode is automatically selected depending on the mode of operation currently selected for the page sorter unit and on the mode of scanning selected as preferential initial scanning mode. The preferential initial scanning mode is selected by the user manipulating the preferential scan-mode select switch 48 in consideration of the most frequently used ranges of the number of documents to be duplicated, the number of printed outputs to be produced and any other parameters that deserve consideration by the user. The mode of copying operation on the basis of which the mode of scanning is to be automatically selected is, particularly, the mode of operation selected for the page sorter unit which forms part of the apparatus and may thus be any of the sorting mode and the grouping mode.

In the preferred embodiment of the present invention which has thus far been described, the document support table 22 is used for both of the scanner-moved and document-moved scanning modes. During scanner-moved mode of scanning operation, the scanner units 24 and 26 are driven to move back and forth below the document support table 22 to scan the document fixedly placed on the table 22. During document-moved mode of scanning operation, the scanner units 24 and 26 are fixedly held in place in the vicinity of the rightmost end of the document support table 22 as shown in FIG. 1 and scan the image on the document being moved at a fixed speed on the upper face of the table 22.

Such document scanning arrangements may however be substituted by the arrangement in which the document support table 22 is used exclusively for the scanner-moved mode of scanning. In this modified form of duplicating apparatus according to the present invention, the document-moved scanning mode of operation is performed with use of an exposure window additionally provided in the vicinity of, for example, the left end of the table 22, though not shown in the drawings. During document-moved mode of scanning operation, the document to be duplicated is thus driven to move on this additional exposure window and is scanned by the scanner units 24 and 26 moved to and held in position below the exposure window.

What is claimed is:

1. In a scan-mode changeable image duplicating apparatus including scanning means for optically scanning a document and having a scanner-moved scanning mode in which said scanning means is driven to move for scanning a document fixedly held in place and a document-moved scanning mode in which said scanning means is fixed to scan a document being moved with respect to the scanning means, a control system comprising (a) initial scan-mode selecting means allowing the user of the apparatus to select one of said scanner-moved and document-moved scanning modes as a preferential initial scanning mode, (b) duplicating mode selecting means allowing the user to select a duplicating mode which is compatible with both of said document-moved and scanner-moved scanning modes, (c) judging means for judging whether or not said duplicating mode is currently selected by said duplicating mode selecting means, and (d) automatic scan-mode selecting means for automatically selecting said preferential initial scanning mode when it is judged by said judging means that said duplicating mode is currently selected by said duplicating mode selecting means.

2. In a scan-mode changeable image duplicating apparatus including scanning means for optically scanning a document and having a scanner-moved scanning mode in which said scanning means is driven to move for scanning a document fixedly held in place and a document-moved scanning mode in which said scanning means is fixed to scan a document being moved with respect to the scanning means, a control system comprising (a) initial scan-mode selecting means allowing the user of the apparatus to select one of said scanner-moved and document-moved scanning modes as a preferential initial scanning mode, (b) duplicating mode selecting means allowing the user to select one of a first-type duplicating mode which is compatible with both of said document-moved and scanner-moved scanning modes and a second-type duplicating mode which is compatible with a particular one of said document-moved and scanner-moved scanning modes, (c) judging means for judging whether said first-type duplicating mode or said second-type duplicating mode is currently selected by said duplicating mode selecting means, and (d) automatic scan-mode selecting means for automatically selecting said preferential initial scanning mode when it is judged by said judging means that said first-type duplicating mode is currently selected by said duplicating mode selecting means and automatically selecting said scanning mode compatible with said second-type duplicating mode when it is judged by said judging means that said second-type duplicating mode is currently selected.

3. A control system as set forth in claim 2, in which said judging means consists of first judging means, the control system further comprising (e) second judging means for judging which of said scanner-moved scanning mode and said document-moved scanning mode is currently selected by said initial scan-mode selecting means as said preferential initial scanning mode, wherein said automatic scan-mode selecting means being operative to automatically select said scanner-moved scanning mode when it is judged by said first judging means that said second-type duplicating mode is currently selected or when it is judged by said first judging means that said first-type duplicating mode is currently selected by said duplicating mode selecting means and additionally it is judged by said second judging means that said scanner-moved scanning mode is currently selected as said preferential initial scanning mode by said initial scan-mode selecting means, and to automatically select said document-moved scanning mode when it is judged by said first judging means that said first-type duplicating mode is currently selected by said duplicating mode selecting means and additionally it is judged by said second judging means that said document-moved scanning mode is currently selected as said preferential initial scanning mode by said initial scan-mode selecting means.

4. A control system as set forth in claim 3, in which said image duplicating apparatus further includes support means for supporting a document thereon, said scanning means being operative to optically scan the document on said support means, and a page sorter unit having a sorting mode as said first-type duplicating mode wherein printed outputs produced from a plurality of documents are to be assorted and a grouping mode as said second-type duplicating mode wherein the printed outputs are to be grouped for each page of the documents.

5. A control system as set forth in claim 4, in which said image duplicating apparatus further includes a recirculating document handler which handles a plurality of documents placed on a document tray thereof so that said plurality of documents are fed one after another from the document tray to said document support means and are returned successively to the document tray on termination of image duplicating operation, said control system further comprising (e) third judging means for judging the availability of said page sorter unit, wherein said scan-mode selecting means is operative to select said document-moved scanning mode with said plurality of documents being handled by said recirculating document handler when it is judged by said third judging means that said page sorter unit is not available in said apparatus.

6. In a scan-mode changeable image duplicating apparatus including support means for supporting a document thereon, scanning means for optically scanning the document on said support means and a page sorter unit having a sorting mode in which printed outputs produced from a plurality of documents are to be assorted and a grouping mode in which the printed outputs are to be grouped for each page of the documents, the apparatus having document scanning modes including a scanner-moved scanning mode in which said scanning means is driven to move with respect to said support means to scan a document fixedly held in place on said support means and a document-moved scanning mode in which said scanning means is fixed with respect to the support means and scans a document being moved on the support means, a control system comprising (a) initial scan-mode selecting means allowing the user of the apparatus to select one of said scanner-moved and document-moved scanning modes as a preferential initial scanning mode, (b) sorter mode selecting means allowing the user to select one of said sorting and grouping modes, (c) first judging means for judging whether said sorting mode or said grouping mode is currently selected for said page sorter unit by said sorter mode selecting means, (d) second judging means for judging which of said scanner-moved scanning mode and said document-moved scanning mode is currently selected by said initial scan-mode selecting means as said preferential initial scanning mode, and (e) automatic scan-mode selecting means for automatically selecting said scanner-moved scanning mode when it is judged by said first judging means that said grouping mode is currently selected by said sorter mode selecting means or when it is judged by said first judging means that said sorting mode is currently selected by said sorter mode selecting means and additionally it is judged by said second judging means that said scanner-moved scanning mode is currently selected as said preferential initial scanning mode by said initial scan-mode selecting means, and automatically selecting said document-moved scanning mode when it is judged by said first judging means that said sorting mode is currently selected by said sorter mode selecting means and additionally it is judged by said second judging means that said document-moved scanning mode is currently selected as said preferential initial scanning mode by said initial scan-mode selecting means.

7. A control system as set forth in claim 6, in which said image duplicating apparatus further includes a recirculating document handler which handles a plurality of documents placed on a document tray thereof so that said plurality of documents are fed one after another from the document tray to said document support means and are returned successively to the document tray on termination of image duplicating operation, said control system further comprising (f) third judging means for judging the availability of said page sorter unit, wherein said scan-mode selecting means is operative to select said document-moved scanning mode with said plurality of documents being handled by said recirculating document handler when it is judged by said third judging means that said page sorter unit is not available in said apparatus.

* * * * *